US006344170B1

(12) United States Patent
Rolander et al.

(10) Patent No.: US 6,344,170 B1
(45) Date of Patent: Feb. 5, 2002

(54) TI(C,N)-(TI,TA,W)(C,N)-CO ALLOY FOR GENERAL FINISHING CUTTING TOOL APPLICATIONS

(75) Inventors: Ulf Rolander, Stockholm; Gerold Weinl, Älvsjö ; Anders Piirhonen, Sandviken; Marco Zwinkels, Solna, all of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/563,501

(22) Filed: May 3, 2000

(30) Foreign Application Priority Data

May 3, 1999 (SE) ..... 9901583

(51) Int. Cl.[7] ..... C22C 14/00
(52) U.S. Cl. ..... 420/417; 420/421; 148/421
(58) Field of Search ..... 148/421; 420/417, 420/421

(56) References Cited

U.S. PATENT DOCUMENTS 3,994,692 A 11/1976 Rudy ..... 29/182.5
4,985,070 A 1/1991 Kitamura et al. ..... 75/238
5,106,674 A 4/1992 Okada et al. ..... 428/217
5,370,719 A 12/1994 Teruuchi et al. ..... 51/308

FOREIGN PATENT DOCUMENTS

| | | |
|---|---|---|
| EP | 0 374 358 | 6/1990 |
| EP | 0 380 096 | 8/1990 |
| WO | 96/22403 | 7/1996 |
| WO | 98/51830 | 11/1998 |

OTHER PUBLICATIONS

Patent Abstracts of Japan, publ. No. 07224346, publication date Aug. 22, 1995.

*Primary Examiner*—Roy King
*Assistant Examiner*—Janelle Combs-Morillo
(74) *Attorney, Agent, or Firm*—Burns, Doane, Swecker & Mathis, L.L.P.

(57) ABSTRACT

The present invention relates to a sintered body of a carbonitride alloy with titanium as main component which has improved properties particularly when used as cutting tool material in general finishing cutting operations requiring high deformation resistance in combination with relatively high toughness. This has been achieved by combining a carbonitride based hard phase of specific chemical composition with an extremely solution hardened Co-based binder phase.

12 Claims, 1 Drawing Sheet

4000x

4000x

TI(C,N)-(TI,TA,W)(C,N)-CO ALLOY FOR GENERAL FINISHING CUTTING TOOL APPLICATIONS

FIELD OF THE INVENTION

Figure 1:
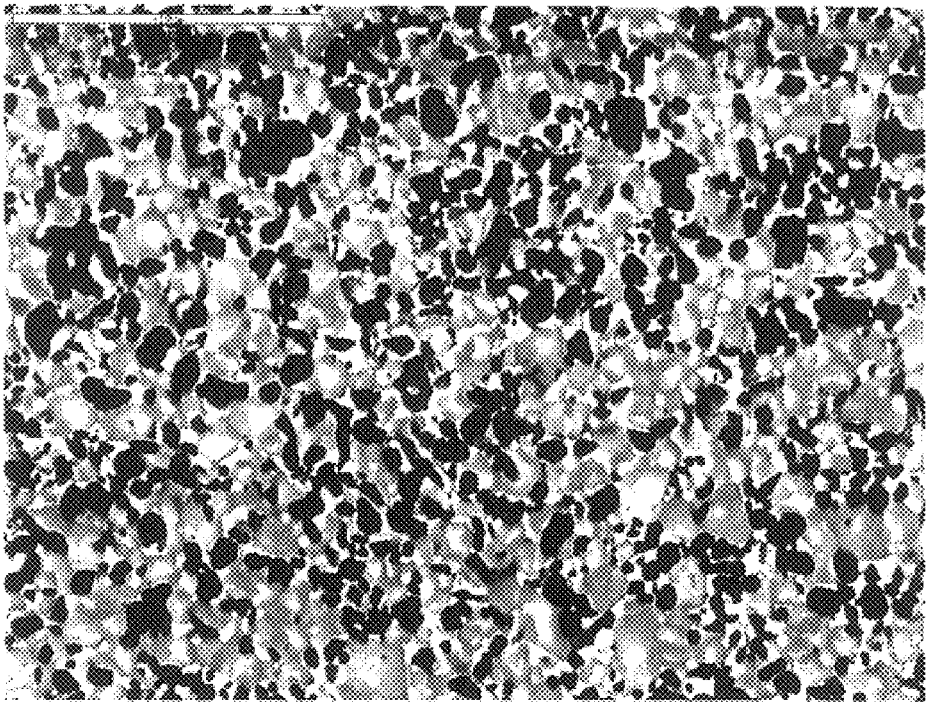

The present invention relates to a sintered body of a carbonitride alloy with titanium as a main component which has improved properties particularly when used as cutting tool material in general finishing cutting operations requiring high deformation resistance in combination with relatively high toughness. More particularly, the present invention relates to a carbonitride based hard phase of specific chemical composition with an extremely solution-hardened Co-based binder phase. Said binder phase has properties similar to the binder phase of WC—Co based materials except that it has been possible to increase the solution hardening beyond the point where eta-phase normally would appear.

BACKGROUND OF THE INVENTION

Titanium-based carbonitride alloys, so called cermets, are produced by powder metallurgical methods and comprise carbonitride hard constituents embedded in a metallic binder phase. The hard constituent grains generally have a complex structure with a core surrounded by a rim of a different composition. In addition to titanium, group VIa elements, normally both molybdenum and tungsten, are added to facilitate wetting between binder and hard constituents and to strengthen the binder by means of solution hardening. Group IVa and/or Va elements, e.g. Zr, Hf, V, Nb, and Ta, are also added in all commercial alloys available today. The carbonitride forming elements are usually added as carbides, nitrides and/or carbonitrides. Historically, the binder phase in cermets has been nickel, most likely because Ti has a high solubility in Ni to facilitate sufficient wetting to obtain a low porosity level. During the 1970s a solid solution binder of cobalt and nickel was introduced. This was probably made possible by improved raw material quality, in particular, a lower impurity level of oxygen. Today all commercial alloys contain 3–25 wt % of a solid solution binder with relative proportions Co/(Co+Ni) in—the range 50–75 at %.

Cermets are today well established as insert material in the metal cutting industry. Compared to WC—Co based materials, cermets have excellent chemical stability when in contact with hot steel, even if the cermet is uncoated, but have substantially lower strength. This makes them most suited for finishing operations, which generally are characterized by limited mechanical loads on the cutting edge and a high surface finish requirement on the finished component. Unfortunately, cermets suffer from unpredictable wear behavior. In a worst case, complete tool failure is caused by bulk fracture which may lead to severe damage of the work piece as well as tool holder and machine. More often, tool failure is caused by small edge line fractures, which abruptly change the surface finish or dimensions obtained. Common for both types of damages is that they are stochastic or sudden in nature and occur without previous warning. For these reasons cermets have a relatively low market share especially in modern, highly automated production which relies on a high degree of predictability to avoid costly production stops.

One way to improve predictability, within the intended application area, would be to increase the toughness of the material and work with a larger safety margin. However, so far this has not been possible without simultaneously reducing the wear- and deformation resistance of the material to a degree, which substantially lowers productivity.

SUMMARY OF THE INVENTION

It is an object of the present invention to solve the problem described above and others. It is indeed possible to design and produce a material with substantially improved toughness while maintaining deformation and wear resistance on the same level as conventional cermets. This has been achieved by working with the alloy system Ti—Ta—W—C—N—Co. Within this system a set of constraints has been found rendering optimum properties for the intended application area.

In one aspect, the present invention provides a titanium based carbonitride alloy containing Ti, Ta, W, C, N and Co, particularly useful for finishing operations requiring high deformation resistance in combination with relatively high toughness characterized in that the binder is formed of 9 to <12 at % Co with only impurity levels of Ni and Fe.

DETAILED DESCRIPTION OF PREFERRED EMBODIMENTS

In preferred aspects of the present invention, conventional Ni containing binder phase is replaced with a Co-based binder as in WC—Co alloys, i.e. the chemically stable hard phase of cermets is combined with the tough binder of cemented carbides. Co and Ni behave substantially differently during deformation and dissolve substantially different amounts of the individual carbonitride formers. For these reasons Co and Ni are not interchangeable as has previously commonly been believed. For, applications such as general finish turning of steel, including light interrupted cuts and profiling, or light finish milling the amount of Co required is 9 to <12 at %, preferably 9–10.5 at %.

The binder must be sufficiently solution hardened. This is accomplished by designing the hard phase in such a way that substantial amounts of predominantly W atoms are dissolved in the Co. It is well known that Ti, Ta, C and N all have low or very low solubility in Co, while W has high solubility. Thus, within this alloy system the binder will be essentially a Co—W solid solution as is the case for WC—Co alloys. Solution hardening is usually measured indirectly as relative magnetic saturation, i.e. the ratio of the magnetic saturation of the binder phase in the alloy compared to the magnetic saturation of an equal amount of pure cobalt. For WC—Co alloys close to the graphite limit, a relative magnetic saturation of "one" is obtained. By decreasing the carbon content of the alloy solution hardening is increased and reaches a maximum at a relative magnetic saturation of about 0.75. Below this value, eta-phase is formed and solution hardening can no longer be increased. For the alloys in the present invention it has been found that solution hardening can be driven substantially further compared to WC—Co alloys by a combination of relatively high N content, high Ta content and low interstitial balance. The exact reason for this is unknown, but leads to improved properties probably since thermal expansion of the cermet hard phase is larger than for WC and thus higher solution hardening is required to avoid fatigue by plastic deformation of the binder phase during thermo-mechanical cycling. The relative magnetic saturation should be kept below 0.75, preferably below 0.65 and most preferably below 0.55.

To combine high toughness and deformation resistance with good edge line quality a material with a high binder phase content combined with a small hard phase grain size is generally required. The conventional way to decrease the grain size in cermets has been to decrease the raw material grain size and increase the N content to prevent grain growth. However, for the alloys of the present invention a high N content alone has not proved sufficient to obtain the desired properties. The solution has instead turned out to be a combination of a relatively high N content (N/(C+N) in the range 25–50 at % (at %=atomic %), preferably 30–45 at %, and most preferably 35–40 at %) and a Ta content of at least 2 at %, preferably in the range 4–7 at % and most preferably 4–5 at %. For alloys with Co-based binder, the grain size is best determined by measuring the coercive force, Hc. For the alloys of the present invention the coercive force should be above 12 kA/m, preferably above 13 kA/m and most preferably 14–17 kA/m.

Within reasonable limits, the amount of W added to the material does not directly influence the properties. However, the W content should be above 2 at %, preferably in the range 3–8 at % to avoid an unacceptably high porosity level.

The material described above is extremely reactive during sintering. Uncontrolled sintering parameters, e.g. conventional vacuum sintering, may lead to several undesirable affect. Examples of such effects are large compositional gradients towards the surface due to interaction with the sintering atmosphere and high porosity due to gas formation within the alloy after pore closure. Thus, sintering of the above-described material is preferably carried out under controlled conditions such as those described in U.S. patent application Ser. No. 09/563,347 now U.S. Pat. No. 6,290, 902, concurrently herewith, the disclosure of which is incorporated herein by reference in its entirety. Using such a process a material is obtained which, within reasonable measurement limits and statistical fluctuations, has the same chemical composition from the center to the surface as well as an evenly distributed porosity of A06 or less, perferably A04 or less.

For cutting operations requiring very high wear resistance it is advantageous to coat the body of the present invention with a thin wear resistant coating using PVD, CVD or a similar technique. It should be noted that the composition of the body is such that any of the coatings and coating techniques used today for WC—Co based materials or cermets may be directly applied. Of course the choice of coating will also influence the deformation resistance and toughness of the material.

EXAMPLE 1

Powders of Ti (C, N), WC, TaC and Co were mixed to obtain the proportions (at %) 37.0 Ti, 3.7 W, 4.5 Ta, 9.7 Co and a N/ (C+N) ratio of 38 at %. The powder was wet milled, spray dried and pressed into TNMG160408-pf inserts.

Inserts in the same style were produced from an other powder, which is a well established grade within its application area.

This grade (P 10) was used as a reference and has the following composition (atom %): 33.8 Ti, 3.5 W, 1.4 Ta, 3.9 Mo, 2.6 V, 7.7 Co, 3.9 Ni and a N/(C+N) ratio of 31 at %.

Inserts from the reference powder were sintered in a standard process while the inserts according to the invention were sintered in a standard process while the inserts according to the invention were sintered according to the sintering process disclosed in U.S. patent application Ser. No. 09/563, 347 now U.S. Pat. No. 6,290, 902. FIG. 1 shows a scanning electron microscopy image of the microstructure obtained for the inserts produced according to the invention.

Measurements of physical properties are shown in the table below:

| | Hc (kA/m) | rel. magn. sat. | density (g/cm$^3$) | porosity (ISO 4505) |
|---|---|---|---|---|
| Reference | n.a. | n.a. | 7.02 | A02 (A08 center) |
| Invention | 1.57 | 0.46 | 7.20 | A04 |

Note that coercive force and relative magnetic saturation are not relevant measurement techniques for Ni-containing alloys since, coercive force does not have a clear coupling to grain size, and relative magnetic saturation is predominantly a measurement of all the other elements dissolved in the binder apart from tungsten.

EXAMPLE 2

Cutting tests in a work piece requiring a cutting tool with high toughness were done with following cutting data:

work piece material: SCR420H

V=200 m/min; f=0.2 mm/r; d.o.c=0.5 mm; coolant

Result: (No. of passes before breakage, average of 4 edges)

Reference: 34

Invention: 92

EXAMPLE 3

Plastic deformation resistance for the both materials was determined in a cutting test.

Work piece material: SS2541

Depth of cut=1 mm, f=0.3 mm/r; cutting time=2.5 min

The result below shows the cutting speed(m/min) when the edges were plastically deformed. (Average of 2 edges)

Reference: 175

Invention: 275

From the examples above it is clear that compared to a prior art material, inserts produced according to the invention have both substantially improved toughness and deformation resistance. While the invention has been described by reference to the elements Ti, Ta, W, C, N and Co, it is obvious that these may to some extent be replaced by small amounts of alternative elements without violating the principles of the invention. In particular, Ta may partly be replaced by Nb and W may partly be replaced by Mo.

The principles, preferred embodiments and mode of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. A titanium based carbonitride alloy comprising Ti, Ta, W, C, N and Co, and a binder phase, the binder is formed of 9 to <12 at % Co with only impurity levels of Ni and Fe, the binder phase is solution hardened mainly by W atoms to obtain a relative magnetic saturation below 0.75 and wherein the alloy is in the form of a body having a center and a surface, the body having substantially the same chemical composition from the center to the surface.

2. The alloy according to claim 1, comprising a coercive force measurement above 12 kA/m.

3. The alloy of claim 2, wherein the coercive force is above 14 kA/m.

4. The alloy of claim 3, wherein the coercive force is 14–17 kA/m.

5. The alloy according to claim 1, wherein the alloy contains more than 2 at % Ta, more than 2 at % W and has a N/(C+N) ratio of 25–50%.

6. The alloy of claim 5, wherein the alloy comprises 4–7 at. % Ta, and a N/(C+N) ratio of 30–45%.

7. The alloy of claim 6, wherein the alloy comprises 4–5 at. % Ta, and a N/(C+N) ratio of 35–40%.

8. The alloy of claim 1, wherein the relative magnetic saturization is below 0.55.

9. The alloy according to claim 1, wherein the alloy has substantially an evenly distributed porosity of A06 or less.

10. The alloy according to claim 9, wherein the alloy has substantially evenly distributed porosity of A04 or less.

11. The alloy of claim 1, wherein Co is present in an amount 9–10.5 at. %.

12. The alloy of claim 1, wherein the relative magnetic saturization is below 0.65.

* * * * *